US005222311A

United States Patent [19]

Lin

[11] Patent Number: 5,222,311

[45] Date of Patent: Jun. 29, 1993

[54] SHOE WITH CUSHIONING WEDGE

[76] Inventor: Mark Lin, No. 173, Pei-Tun Rd., Taichung City, Taiwan

[21] Appl. No.: 832,955

[22] Filed: Feb. 10, 1992

[51] Int. Cl.[5] ..... A43B 13/14; A43B 13/18

[52] U.S. Cl. ..... 36/28; 36/30 R; 36/17 R

[58] Field of Search ..... 36/12, 16, 17 R, 19.5, 36/18, 28, 30 R, 114

[56] References Cited

U.S. PATENT DOCUMENTS

| | | | |
|---|---|---|---|
| 2,605,559 | 8/1952 | Vail | 36/17 R |
| 2,675,632 | 4/1954 | Levin | 36/12 |
| 3,736,613 | 6/1973 | Tuba et al. | 36/17 R |
| 3,739,502 | 6/1973 | Auberry | 36/17 R |
| 4,391,048 | 7/1983 | Lutz | 36/28 |
| 4,594,799 | 6/1986 | Lin | 36/30 R |
| 4,733,483 | 3/1988 | Lin | 36/28 |
| 4,881,328 | 11/1989 | Yung-Mao | 36/28 |
| 4,908,962 | 3/1990 | Yung-Mao | 36/28 |
| 5,005,300 | 4/1991 | Diaz et al. | 36/28 |

*Primary Examiner*—Steven N. Meyers
*Assistant Examiner*—M. D. Patterson
*Attorney, Agent, or Firm*—Lockwood Alex FitzGibbon & Cummings

[57] ABSTRACT

A shoe includes an outsole which has a flat tread portion and a peripheral member that extends upwardly from the periphery of the tread portion. The peripheral member has an upper section and a lower section. The tread portion and the lower section of the peripheral member cooperatively define a receptacle. A resilient cushioning wedge is adapted to be received in the receptacle and has an upper base member with a top side and a bottom side. The bottom side is integrally formed with a plurality of downwardly extending cushioning elements which have free ends glued to the tread portion. The base member has a periphery glued to the peripheral member. An insole is glued to the top side of the cushioning wedge. The shoe further includes a vamp which has a bottom end sewed to the insole and a bottom periphery sewed to the upper section of the peripheral member.

6 Claims, 2 Drawing Sheets

SHOE WITH CUSHIONING WEDGE

BACKGROUND OF THE INVENTION

1. Field of the Invention

The invention relates to an athletic or active wear shoe, more particularly to an athletic or active wear shoe which has a cushioning wedge.

2. Description of the Related Art

U.S. Pat. No. 4,733,483 by the applicant discloses a shoe which comprises a replaceable insert and an outsole which has a top surface that is hollowed out so as to form a central receptacle for receiving the insert. The insert includes a base member and a plurality of independent convex cushioning elements which extend downwardly from the base member. The insert is replaceable so that the cushionability and resiliency of the same may be selected according to the wearer's preference.

The process for fabricating the above described shoe is relatively complicated since the outsole has to be hollowed out to form the receptacle. When hollowing out the outsole, utmost care should be undertaken so as to ensure that the dimensions of the receptacle will correspond to the construction of the insert. Otherwise, the insert will not fit properly in the receptacle, thus making the shoe uncomfortable to wear.

SUMMARY OF THE INVENTION

Therefore, the objective of the present invention is to provide a shoe with a cushioning wedge, said shoe having a fabrication process which is less complicated.

Accordingly, the preferred embodiment of a shoe of the present invention comprises:

an outsole having a flat tread portion and a peripheral member extending upwardly from the periphery of the tread portion, said peripheral member having an upper section and a lower section, said tread portion and the lower section of said peripheral member cooperatively defining a receptacle;

a cushioning wedge adapted to be received in the receptacle and having an upper base member with a top side and a bottom side, said bottom side being integrally formed with a plurality of downwardly extending cushioning elements which have free ends glued to the tread portion, said base member having a periphery glued to the peripheral member;

an insole glued to the top side of the cushioning wedge; and a vamp having a bottom end sewed to the insole and a bottom periphery sewed to the upper section of the peripheral member.

BRIEF DESCRIPTION OF THE DRAWINGS

Other features and advantages of the present invention will become apparent in the following detailed description of the preferred embodiment, with reference to the accompanying drawings, of which.

DETAILED DESCRIPTION OF THE PREFERRED EMBODIMENT

Figure 1:
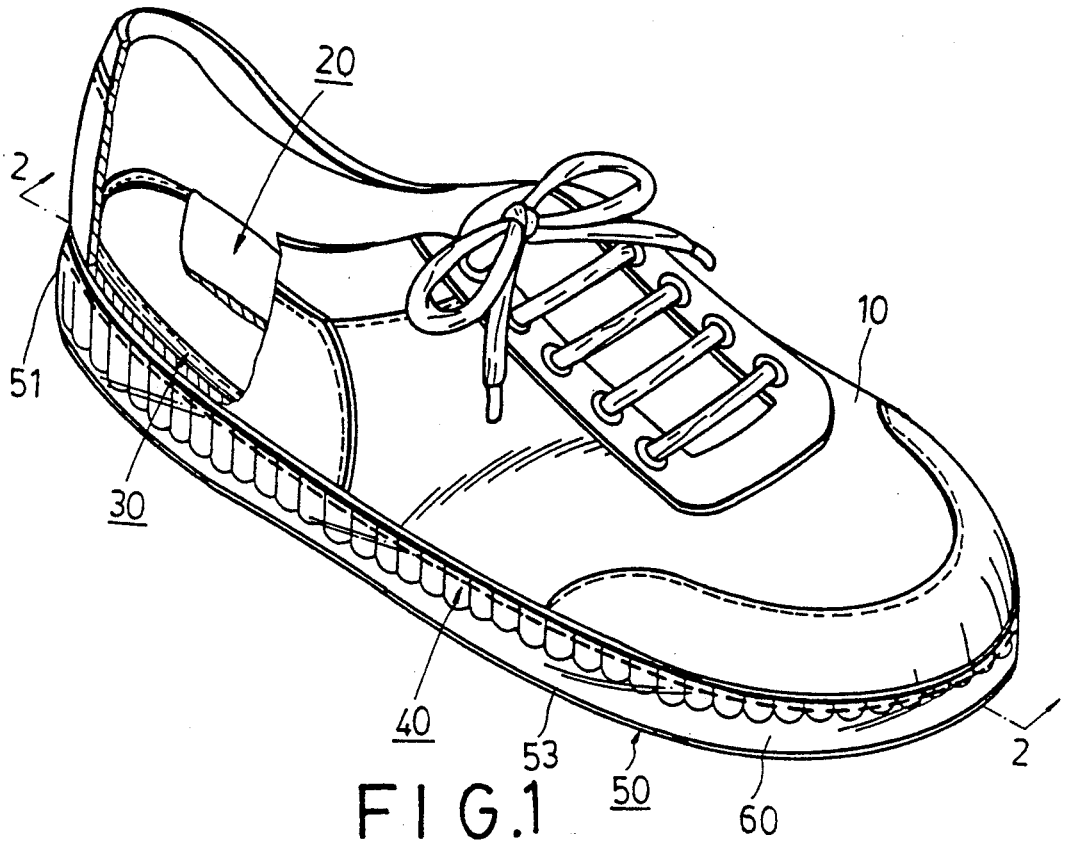
FIG. 1 is a perspective view of the preferred embodiment of a shoe according to the present invention.
Figure 3:
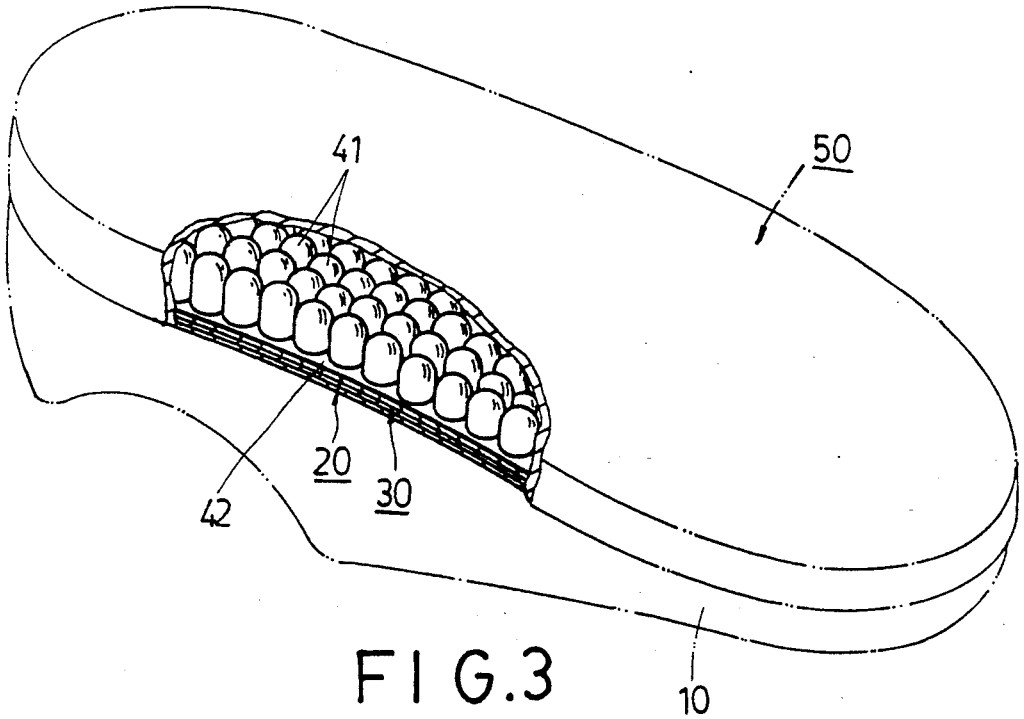
FIG. 3 is a rear perspective view of the preferred embodiment with parts broken away to show the cushioning wedge thereof.
Figure 2:
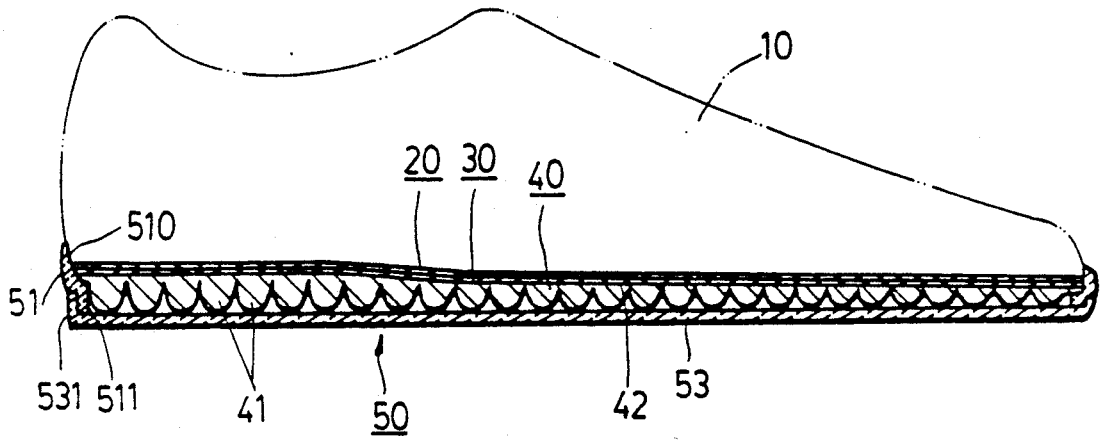
FIG. 2 is a longitudinal section taken substantially along lines 2—2 of FIG. 1.

Referring to FIGS. 1, 2 and 3, the preferred embodiment of an active wear shoe of the present invention is shown to comprise a vamp (10), a liner (20), an insole (30), a cushioning wedge (40) and an outsole (50).

The cushioning wedge (40) is made of a resilient material and includes an upper base member (42) and a plurality of cushioning elements (41) which are integrally formed with and which extend downwardly from the base member (42). The cushioning elements (41) are formed as a plurality of closely-packed independent pillars with rounded free ends. Note that the height of the cushioning elements (41) gradually decreases from the rear or heel portion of the cushioning wedge (40) to the front or ball portion of the same.

The outsole (50) is made of a transparent material and includes a peripheral member (51) and a flat tread portion (53). The flat tread portion (53) is provided with an upwardly extending peripheral flange (531). The peripheral member (51) has a lower section (511), the depth of which corresponds to the height of the cushioning elements (41). Thus, the depth of the lower section (511) similarly decreases gradually from the rear portion to the front portion of the outsole (50). The peripheral member (51) is secured to the tread portion (53) by gluing the lower section (511) to the peripheral flange (531). The peripheral member (51) and the tread portion (53) cooperatively define a receptacle (60) that is adapted to receive the cushioning wedge (40).

The free ends of the cushioning elements (41) are glued to the tread portion (53), and the periphery of the base member (42) is glued to the peripheral member (51) when the cushioning wedge (40) is placed in the receptacle (60). The transparent properties of the outsole (50) permit the viewing of the structure of the cushioning wedge (40), as shown in FIG. 3.

The insole (30) is machine sewed to the bottom end of the vamp (10). The liner (20) is provided on top of the insole (30). The bottom periphery of the vamp (10) is machine sewed to an upper section (510) of the peripheral member (51). The bottom surface of the insole (30) is preferably glued to the base member (42) of the cushioning wedge (40).

Figure 4:
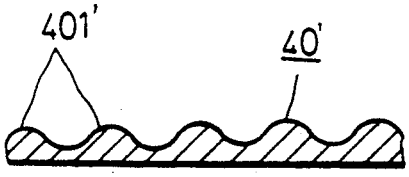
FIG. 4 is a sectional view of another cushioning wedge for the shoe of the present invention.
Figure 5:
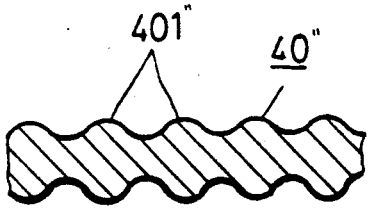
FIG. 5 is a sectional view of still another cushioning wedge for the shoe of the present invention.

The construction of the cushioning wedge for the shoe of the present invention should not be limited to that shown in FIGS. 1 to 3. Referring to FIG. 4, a cushioning wedge (40') is shown to have a base member with a top side to be secured to the insole and a bottom side provided with a plurality of closely-packed concave cushioning elements (401'). Referring to FIG. 5, a cushioning wedge (40'') is shown to have a base member, the two sides of which are provided with a plurality of closely-packed concave cushioning elements (401'').

Note that the cushioning elements can be made in a variety of different shapes and sizes, such as concave protrusions, spaced elongated strips, rectangular prisms, etc.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A shoe, comprising:

an outsole having a flat tread portion and a peripheral member extending upwardly from a periphery edge of said tread portion, said peripheral member having an upper section and a lower section, said tread portion and said lower section of said peripheral member cooperatively defining a receptacle;

a cushioning wedge adapted to be received in said receptacle and having an upper base member with a top side and a bottom side, said bottom side being integrally formed with a plurality of downwardly extending cushioning elements which have free ends glued to said tread portion, said base member having a periphery glued to said peripheral member;

an insole glued to said top side of said cushioning wedge; and a vamp having a bottom end sewed to said insole and a bottom periphery sewed to said upper section of said peripheral member.

2. The shoe as claimed in claim 1, wherein said cushioning elements are closely-packed independent pillars with rounded free ends.

3. The shoe as claimed in claim 1, wherein:

the height of said cushioning elements gradually decreases from a rear portion to a front portion of said cushioning wedge; and said lower section of said peripheral member has a depth which corresponds to the height of said cushioning elements.

4. The shoe as claimed in claim 1, wherein said outsole is made of a transparent material.

5. The shoe as claimed in claim 1, wherein said cushioning elements are closely-packed concave cushioning elements.

6. The shoe as claimed in claim 5, wherein said top side of said base member is provided with a plurality of closely-packed concave cushioning elements.

* * * * *